US009695565B2

(12) United States Patent
Maini

(10) Patent No.: US 9,695,565 B2
(45) Date of Patent: Jul. 4, 2017

(54) JACKUP PEDESTAL CRANE INSTALLATION AND OPERATION, MOVABLE ALONG A GUIDE

(71) Applicant: ZENTECH, INC., Houston, TX (US)

(72) Inventor: Ramesh Maini, Houston, TX (US)

(73) Assignee: Zentech, Inc., Houston, TX (US)

( * ) Notice: Subject to any disclaimer, the term of this patent is extended or adjusted under 35 U.S.C. 154(b) by 149 days.

(21) Appl. No.: 14/535,708

(22) Filed: Nov. 7, 2014

(65) Prior Publication Data

US 2015/0122760 A1 May 7, 2015

Related U.S. Application Data

(60) Provisional application No. 61/901,371, filed on Nov. 7, 2013.

(51) Int. Cl.

| | |
|---|---|
| ***E02B 17/00*** | (2006.01) |
| ***B66C 7/00*** | (2006.01) |
| ***B66C 23/18*** | (2006.01) |
| ***B66C 23/20*** | (2006.01) |
| *E02B 17/02* | (2006.01) |

(52) U.S. Cl.

CPC ..... *E02B 17/00* (2013.01); *B66C 7/00* (2013.01); *B66C 23/18* (2013.01); *B66C 23/20* (2013.01); *E02B 17/021* (2013.01)

(58) Field of Classification Search

CPC .... B66C 7/00; B66C 7/02; B66C 7/04; B66C 7/06; B66C 7/08; B66C 7/10

See application file for complete search history.

(56) References Cited

U.S. PATENT DOCUMENTS

| | | | | |
|---|---|---|---|---|
| 3,292,559 | A * | 12/1966 | Cousins | B66C 7/00 104/246 |
| 3,930,583 | A | 1/1976 | Jouffray | |
| 6,390,732 | B1 | 5/2002 | Kristensen et al. | |
| 7,815,398 | B2 | 10/2010 | Altman et al. | |

OTHER PUBLICATIONS

International Search Report and Written Opinion dated Feb. 11, 2015 for Application No. PCT/US2014/064526.

* cited by examiner

*Primary Examiner* — R. J. McCarry, Jr.

(74) *Attorney, Agent, or Firm* — Patterson & Sheridan, LLP

(57) ABSTRACT

The present disclosure generally relates to marine rig equipment, and specifically to a mobile jackup rig having one or more moveable cranes. The one or more moveable cranes are configured to operate along a rail, and the one or more moveable cranes are positioned to reach more than one work site location. In one embodiment, a mobile jackup rig includes at least one two-rail system having a first guide-track rail and a second guide-track rail, and at least one moveable crane positioned to operate along the two-rail system. In another aspect, a mobile jackup rig may include at least one moveable pedestal crane positioned on at least one curved or straight guide-track rail system.

20 Claims, 8 Drawing Sheets

JACKUP PEDESTAL CRANE INSTALLATION AND OPERATION, MOVABLE ALONG A GUIDE

CROSS-REFERENCE TO RELATED APPLICATIONS

This application claims benefit of U.S. provisional patent application Ser. No. 61/901,371, filed Nov. 7, 2013, which is herein incorporated by reference.

BACKGROUND

Field of the Disclosure

Embodiments of the present disclosure generally relate to rig equipment. More specifically, embodiments of the disclosure relate to a mobile jackup oil rig having a crane, as well as to mobile jackup rigs used for other purposes, such as accommodations, platform decommissioning work, etc.

Description of the Related Art

Offshore marine oil exploration and drilling is often undertaken from mobile offshore drilling units, the type of mobile offshore drilling unit selected based on the drilling location water depth and remoteness from land. Jackup rigs are one such mobile offshore drilling unit, which commonly include a watertight barge or hull that floats on the water's surface until the jackup rig reaches the desired drilling location. Upon reaching the desired drilling location, three or more jacking towers of the jackup rig are jacked downward through slots or openings in the hull of the jackup rig, into the water, and into the sea floor to anchor the rig to the sea floor. With the rig anchored, the jackup rig can be raised above the water to accommodate anticipated changes in sea level height, such that waves, tides, and currents do not cause undesirable changes in the location and orientation of the barge, platform, or drilling package.

The jackup rig and its deck have limitations with respect to the amount of available space and weight capacity. Drilling equipment, supplies, living quarters, and other essentials required on the platform deck, or floor, during drilling operations must be moved, stored, and/or located on the jackup rig deck platform, all of which affect the size of the jackup rig. Within the oil and gas industry there is a drive to lower the cost of oil rigs and platforms.

Current jackup rigs maintain three or more fixed pedestal cranes on their deck platforms in order to service all areas of the jackup rig, the jackup rig deck platform, and areas adjacent the jackup rig. Each pedestal crane is secured in its location such that it cannot move about the jackup rig deck platform, but can only rotate about the longitudinal axis of the pedestal. Maintaining three or four pedestal cranes per jackup rig significantly increases the weight of the overall jackup rig, and decreases the amount of useable space on the jackup rig. Less usable deck space results in less equipment that may be carried on the jackup rig deck, a reduction in the number of personnel able to be supported by the rig, a greater frequency of supply boat dockings to receive, or trade out, supplies, equipment, and personnel, a reduction in workspace, and a reduction in the types of materials that may be brought onto the jackup rig. Furthermore, the requirement of three or more pedestal cranes on a jackup rig increases the cost to build, operate, and maintain the jackup rig. More pedestal cranes require more maintenance, spare parts, technicians, and operators, further using up jackup rig space.

Therefore, there is a need for a reduction in the weight and amount of equipment required to fully operate a jackup rig during oil exploration, drilling operations, or other rig operations, or to enable additional equipment to be carried thereon.

SUMMARY

The present disclosure generally relates to rig equipment, and specifically to a mobile jackup oil rig having one or more moveable cranes, as well as to non-drilling related jackup rig applications. The one or more moveable cranes are configured to operate along a rail, and the one or more moveable cranes are positioned to reach more than one work site location. In one embodiment, a mobile jackup rig includes at least one two-rail system having a first guide-track rail and a second guide-track rail, and at least one moveable crane positioned to operate along the two-rail system. In another aspect, a mobile jackup rig may include at least one moveable pedestal crane positioned on at least one curved guide-track rail system.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting in scope, as the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The present disclosure generally relates to oil drilling rig equipment, and specifically to a mobile jackup oil rig having one or more moveable cranes. The one or more cranes are configured to operate along a rail or guide-track. In one embodiment, a mobile jackup rig includes at least one two-rail system having a first guide-track rail and a second guide-track rail, and at least one moveable crane positioned to reach more than one work site location on the jackup rig or adjacent thereto and to operate along the two-rail system. In another aspect a mobile jackup rig may include at least one pedestal crane positioned to reach more than one work site location on the jackup rig or adjacent thereto on at least one curved guide-track rail system.

The term "work site location" as used herein includes, for example, a unique area of the jackup rig, jackup rig deck platform, or area adjacent thereto from which a jackup rig crane is able perform lifts such that the material lifted may be moved from a first location to a second location. It is contemplated that the term "work site location" is not intended to be limiting and may include various examples beyond those described.

Figure 1:
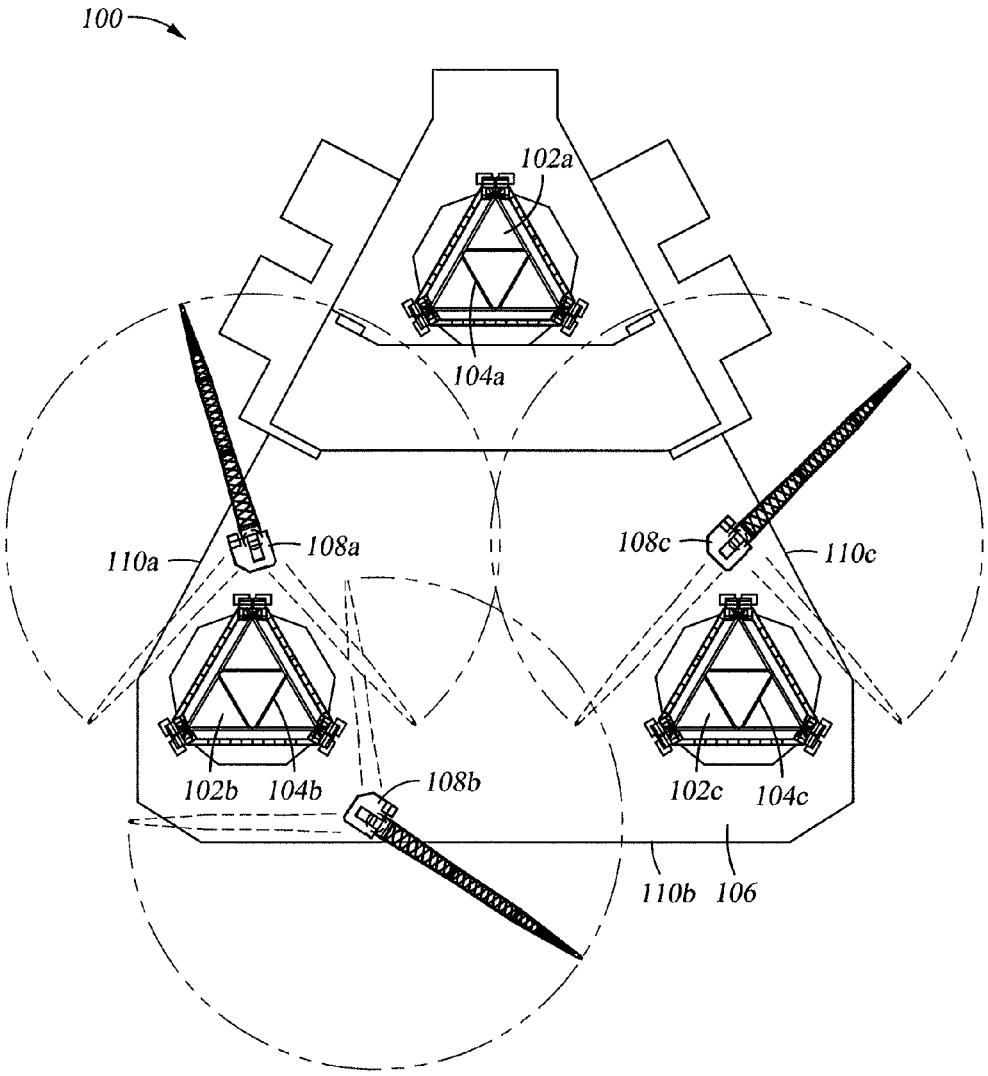
FIG. 1 illustrates a plan view of a conventional jackup rig deck platform having three pedestal cranes fixed to the deck platform.

FIG. 1 illustrates a conventional jackup rig 100 for marine drilling. The jackup rig 100 can be jacked up through three openings 102*a*, 102*b*, 102*c* in the hull of the jackup rig 100 using three jacking towers 104*a*, 104*b*, 104*c* such that the bases of the jacking towers 104*a*, 104*b*, 104*c* are resting on or in the sea floor and lift the jackup rig hull from the water. In order to service the jackup rig 100, the jackup rig deck platform 106, and adjacent waters (not shown), the jackup rig 100 must carry pedestal cranes 108*a*, 108*b*, 108*c* such that all areas of the jackup rig deck platform 106 and adjacent waters may be accessed. As illustrated in FIG. 1, conventional jackup rigs utilize one fixed pedestal crane 108*a*, 108*b*, 108*c* adjacent each of the primary sides of the jackup rig 100 thus allowing each pedestal crane 108*a*, 108*b*, 108*c* to service one unique work site location of the jackup rig 100, jackup rig deck platform 106, and adjacent waters (not shown), with overlapping locations of the booms so that loads may be shuttled across the deck platform 106. Each pedestal crane 108*a*, 108*b*, 108*c* may be fixed near an outer edge 110*a*, 110*b*, 110*c* of the jackup rig deck platform 106 such that each pedestal crane 108*a*, 108*b*, 108*c* may be used to service a different side of the jackup rig deck platform 106 and adjacent waters. Each fixed pedestal crane 108*a*, 108*b*, 108*c* of conventional jackup rigs 100 can service only a discrete section of a jackup rig deck platform 106; each individual section only being serviceable by one fixed pedestal crane 108*a*, 108*b*, 108*c* due to the limitations of the pedestal crane's movement and size requirements. In order to maintain adequate operational coverage of the jackup rig deck platform 106 by the fixed pedestal cranes 108*a*, 108*b*, 108*c*, and be able to lift materials and supplies from a supply boat or adjacent waters onto the jackup rig deck platform 106, a jackup rig deck platform 106 typically requires the use of three or four fixed pedestal cranes, each pedestal crane reducing available deck space and adding substantial weight to the jackup rig.

However, this is a problem because jackup rigs and their decks have limitations with respect to the amount of available space and weight capacity. Drilling equipment, supplies, living quarters, and other essentials must be moved, stored, and/or located on the jackup rig and its deck platform. Having at least three, and oftentimes four, fixed pedestal cranes and the operating personnel and spare parts on each jackup rig significantly increases the weight of the overall jackup rig as well as decreases the amount of space available for personnel, working, moving and storing materials and equipment, carrying test equipment, and the like.

Figure 2:
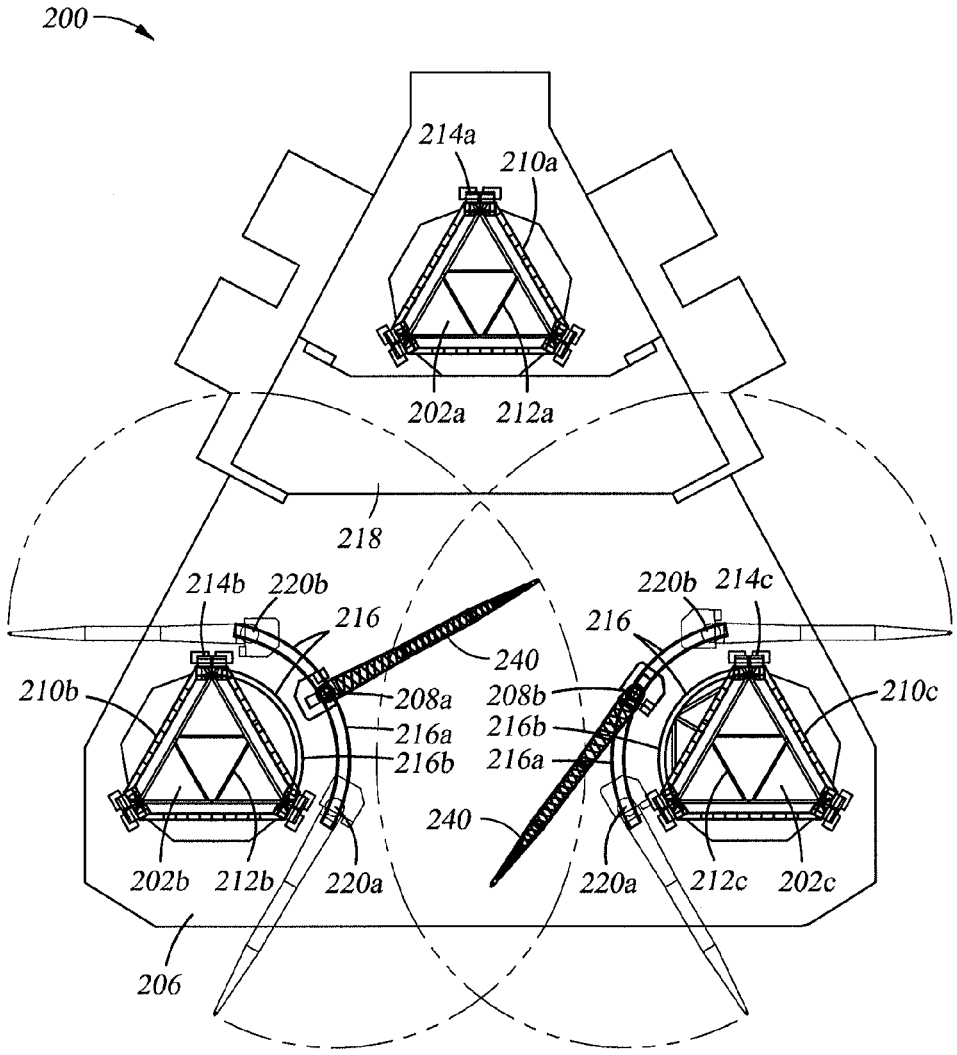
FIG. 2 illustrates a plan view of a jackup rig deck platform having two guide-track mounted movable pedestal cranes, according to one embodiment.

FIG. 2 illustrates an embodiment of a mobile jackup rig 200 for marine drilling having two guide-track mounted movable pedestal cranes 208*a*, 208*b*. In one embodiment, the first movable pedestal crane 208*a* may be equivalent in size and configuration to the second movable pedestal crane 208*b*; however, it is contemplated that the first and second movable pedestal cranes 208*a*, 208*b* may be sized differently depending on the requirements of the jackup rig 200. As shown, a jackup rig 200 maintains an operational deck platform 206 for conducting oil exploration and drilling procedures, supporting quarters 218, supporting control and operations rooms, storing materials and equipment, and the like. The jackup rig 200 of FIG. 2 illustrates three openings 202*a*, 202*b*, 202*c* extending completely through the deck platform 206 and hull of the jackup rig 200 such that a body of water can be accessed below. Each opening 202*a*, 202*b*, 202*c* is surrounded by a jacking frame 210*a*, 210*b*, 210*c* on the deck level of the jackup rig 200 which may be connected to the jackup rig deck platform 206. Each jacking frame 210*a*, 210*b*, 210*c* completely surrounds and supports a jacking tower 212*a*, 212*b*, 212*c* and stores the required equipment and gear box 214*a*, 214*b*, 214*c* for raising and lowering the jacking towers 212*a*, 212*b*, 212*c* into and out of the water.

Movable pedestal cranes 208*a*, 208*b* are positioned to be coupled to and supported/guided by each of the guide-tracks 216. As space is limited on the jackup rig deck platform 206, a crane 208*c* is positioned upon a vertical pedestal 208*d*, thus creating a movable pedestal crane 208*a*, 208*b*, in order to allow the crane 208*c* to maneuver above the jackup rig deck platform 206 while leaving deck space open and available for other uses. The movable pedestal crane 208*a*, 208*b* and guide-track 216 may be placed at a location on the jacking frame 210*a*, 210*b*, 210*c* such that the boom 240 of the movable pedestal crane 208*a*, 208*b* is able to clear the height of the quarters 218, other equipment, and/or other obstructions that may protrude above the floor of the jackup rig deck platform 206.

In the embodiment shown in FIG. 2, the two guide-track mounted movable pedestal cranes 208*a*, 208*b* achieve substantially similar crane coverage as that of the three fixed pedestal cranes 108*a*, 108*b*, 108*c* illustrated in FIG. 1. As shown in FIG. 2 with reference to FIG. 5, a first movable pedestal crane 208*a* may be mounted to a first guide-track 216 having a lower track 216*a* and an upper track 216*b*, and a second movable pedestal crane 208*b* may be mounted to a second guide-track 216 having a lower track 216*a* and an upper track 216*b*. In one embodiment, the first guide-track 216 may have the same construction as the second guide-track 216; however, it is contemplated that the first and second guide-tracks 216 may be sized differently depending on the requirements of the jackup rig 200.

The guide-tracks 216 are shaped in an arc configuration, such as along a portion of the circumference of a circle, but may also be formed in other shapes such as a linear configuration or a circular configuration. In one embodiment, the arc length semi-circle may be about 180 degrees or less, such as 15 degrees to about 120 degrees, such as 30 to 90 degrees. The arcuate guide-track 216 is located, fixed upon, connected to, and/or welded to the jackup rig deck platform 206 and/or may be located, fixed upon, connected to, and/or welded to a portion of a jacking tower frame 210*a*, 210*b*, 210*c* of the jackup rig platform deck 206. Alternatively, the jacking frame 210*a*, 210*b*, 210*c* may support the movable pedestal cranes 208*a*, 208*b* and transfer the weight of the movable pedestal cranes 208*a*, 208*b* to the entire jackup rig 200. Each movable pedestal crane 208*a*, 208*b* is guidable along the guide-track 216 to the desired location where lifts or drops of equipment, supplies, etc. may be made in order to maximize lifting coverage from the jackup rig deck platform 206 or adjacent waters. The guide-track 216 allows the movable pedestal crane 208*a*, 208*b* to be moved about the jackup rig deck platform 206 such that each movable pedestal crane 208*a*, 208*b* may service at least two sides of the jackup rig 200 and the adjacent waters.

Figure 5:
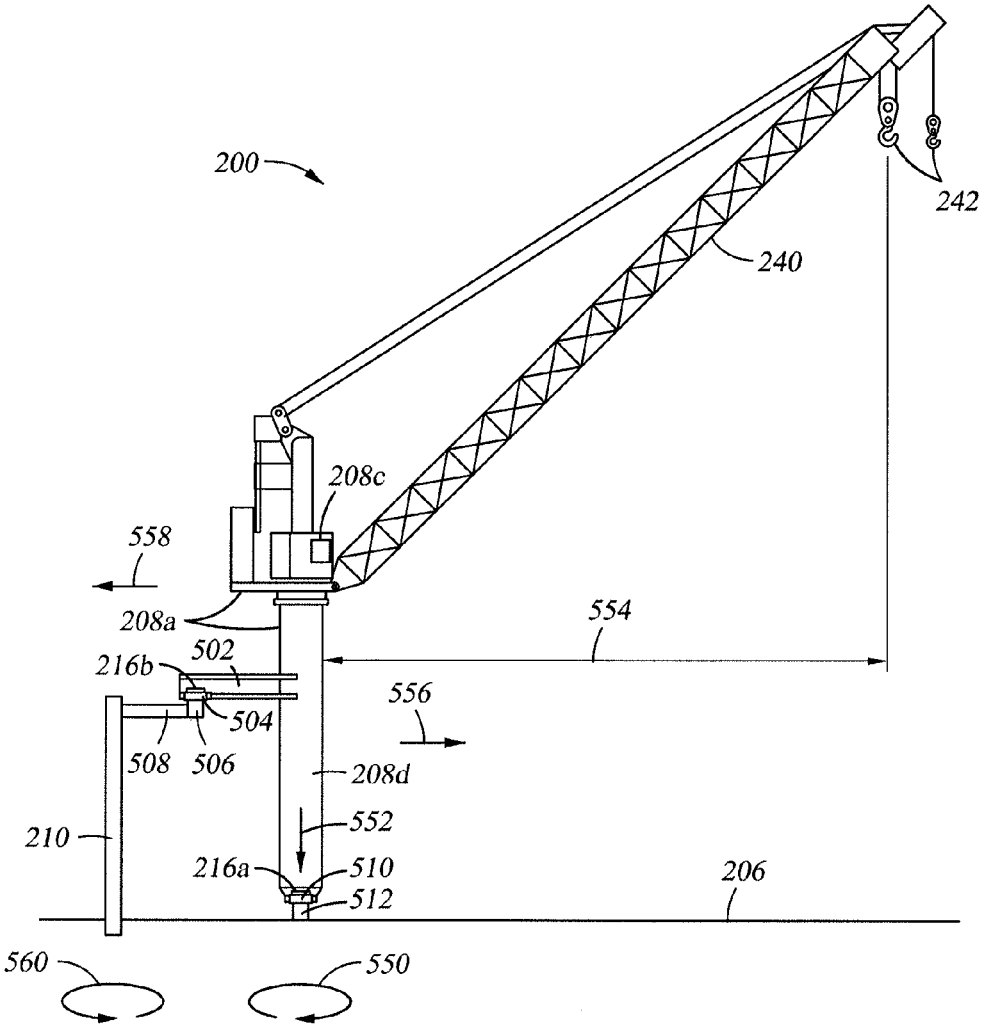
FIG. 5 illustrates a side view of an embodiment of a guide-track mounted movable pedestal crane.

In the embodiment of FIG. 2 and FIG. 5, the lower track 216*a* of each guide-track 216 is secured to the jackup rig deck platform 206, for example, using fasteners or a welded connection. The lower track 216*a* supports the weight of the movable pedestal crane 208*a*, 208*b* which is posited vertically thereabove. The lower track 216*a* may also guide the movable pedestal crane 208*a*, 208*b* during movement, and may also transfer the load to the jackup rig deck platform 206 thus improving movable pedestal crane 208*a*, 208*b* stability when fixed during crane operation. The upper track 216*b* of each guide track 216 is secured to the jacking frame 210*a*, 210*b*, 210*c*, for example, using fasteners or a welded connection. The upper track 216*b* provides stability and lateral support to the movable pedestal crane 208*a*, 208*b* while stationary or while moving along the guide-track 216. The upper track 216*b* may also guide the movable pedestal crane 208*a*, 208*b* for movement, may act to transfer, or carry, a moment—a force acting to pull the top of the movable pedestal crane 208*a*, 208*b* away from the upper guide-track 216*b*—of the movable pedestal crane 208*a*, 208*b*, may act as a counterweight to the movable pedestal crane 208*a*, 208*b*, and/or may stabilize the movable pedestal crane 208*a*, 208*b*.

In FIG. 2, two movable pedestal cranes 208*a*, 208*b* are shown; however, it is contemplated that the jackup rig 200 may include more or less than two movable pedestal cranes 208*a*, 208*b*. Each of the movable pedestal cranes 208*a*, 208*b* are mounted to the guide-tracks 216 to facilitate movement of the movable pedestal cranes 208*a*, 208*b* thereon to different locations on the jackup rig deck platform 206, thus increasing the operating range of each of the movable pedestal cranes 208*a*, 208*b*. Two movable pedestal cranes 208*a*, 208*b* mounted to the guide-track 216 may provide the same or substantially similar lift or drop coverage area as the conventional jackup rig 100 shown in FIG. 1, which utilizes three fixed cranes 108*a*, 108*b*, 108*c*, because the arc shaped guide-track 216 and/or linear guide-track 216 allows the movable pedestal crane 208*a*, 208*b* to move from a first location of the jackup rig 220*a* to a second location of the jackup rig 220*b* along the guide-track 216. In particular, not only can each movable pedestal crane 208*a*, 208*b* move about the jackup rig 200 to increase the movable pedestal crane's 208*a*, 208*b* coverage area of the deck platform 206 and adjacent waters that the boom 240, and thus crane hooks 242, can reach, but also, each movable pedestal crane 208*a*, 208*b* can move to avoid stationary objects secured to the jackup rig 200 which would otherwise be an operational hindrance. To illustrate, the movable pedestal crane 208*a*, 208*b* can move such that the lift location of the crane hooks 242 can avoid stationary objects secured to, or with, the jackup rig 200 such as drill parts, materials, the drilling package, the quarters 218, and the like. A fixed pedestal crane can maintain only a fixed arc on the deck platform which can be used for lifting and dropping loads only along the path of the fixed arc. Because the movable pedestal cranes 208*a*, 208*b* are moveable to increase the effective range of each crane, and because the movable pedestal cranes 208*a*, 208*b* are movable to avoid obstacles on the jackup rig 200 which would otherwise prohibit certain movements/operations of fixed cranes, the moveable pedestal cranes 208*a*, 208*b* are able to service a jackup rig 200 of a particular size using fewer cranes than a jackup rig utilizing fixed pedestal cranes. A reduction in the number of pedestal cranes used to service a jackup rig results in a lower total weight of the fixed equipment on the jackup rig as well as increased space savings as compared to jackup rigs utilizing fixed pedestal cranes. The weight reduction and space savings gained through the inclusion of movable pedestal cranes results in reduced equipment costs, reduced maintenance costs, reduced operation costs, and greater flexibility in the location of equipment on the jackup rig deck platform 206 floor, thus further improving the overall effectiveness of the jackup rig.

Figure 3B:
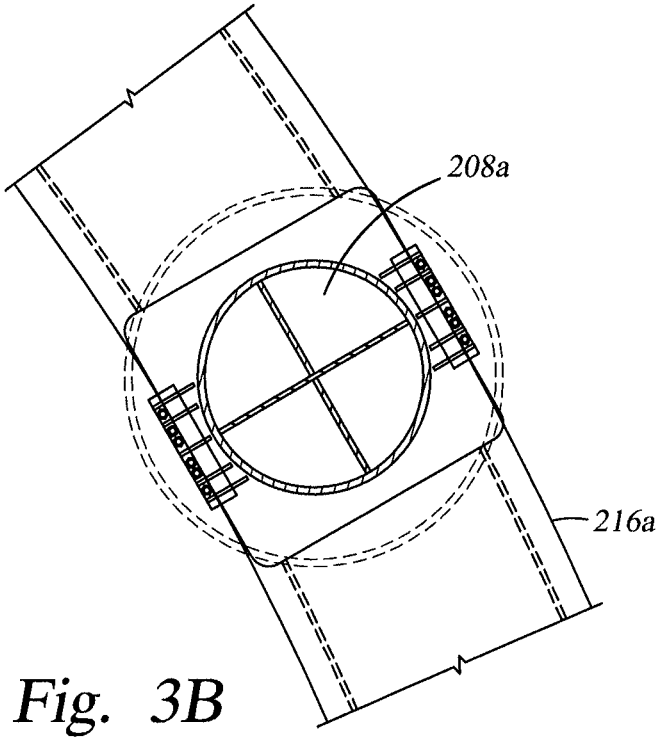
FIGS. 3A and 3B illustrate a plan view of an embodiment of a guide-track mounted movable pedestal crane located about a stern jacking frame of a jackup rig deck platform. In this view, the guide-track is formed in a partial arc.
Figure 3A:
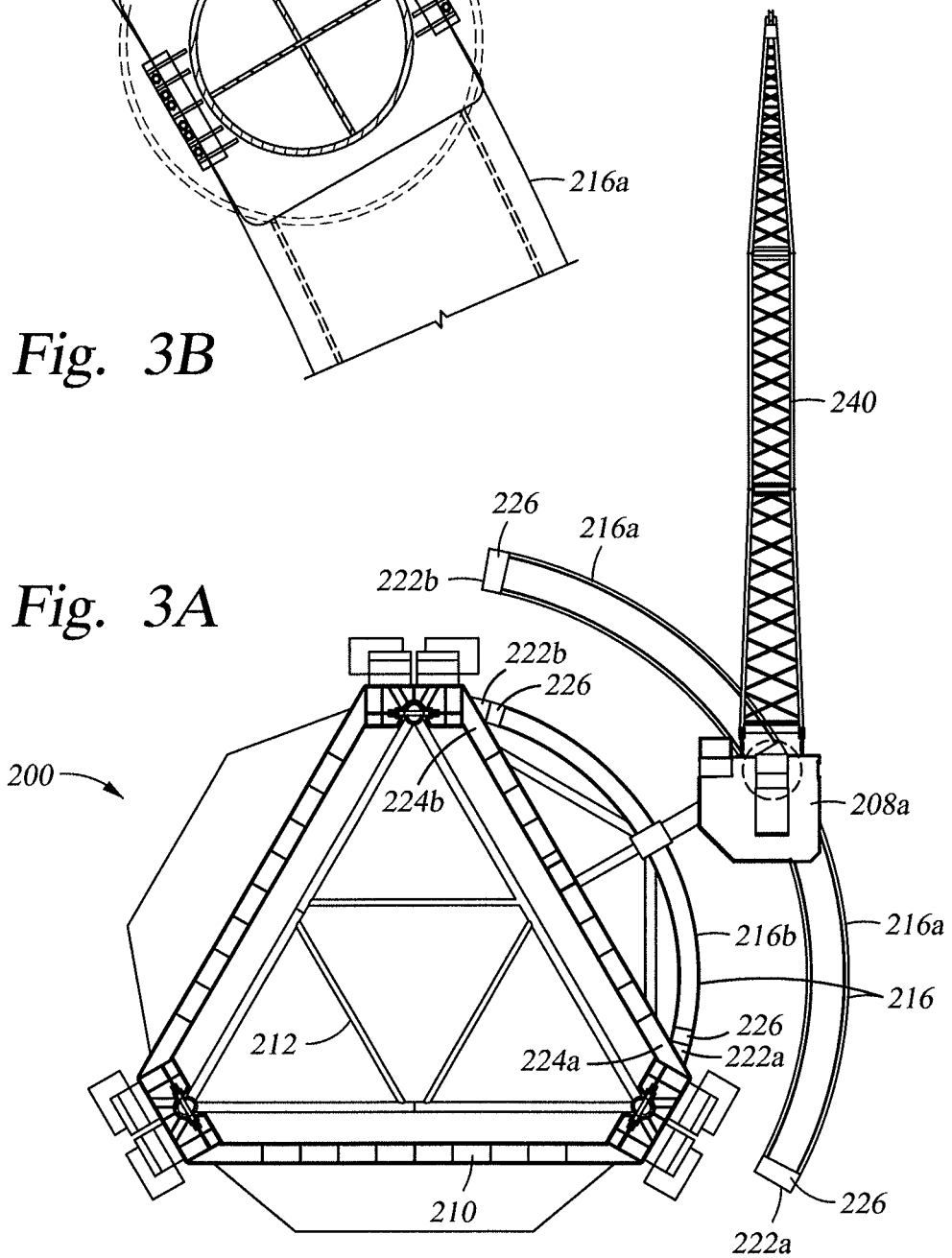
Figure 4B:
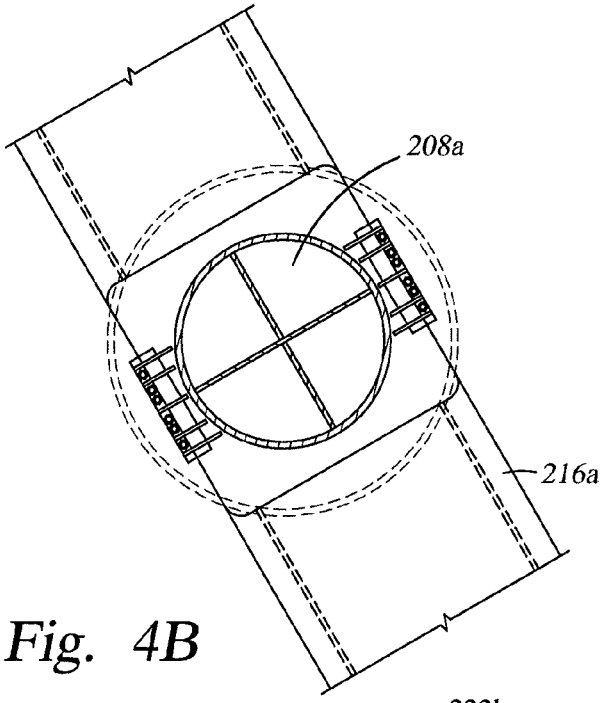
FIGS. 4A and 4B illustrate a plan view of another embodiment of a guide-track mounted movable pedestal crane located about a stern jacking frame of a jackup rig deck platform. In this view, the guide-track is formed in a linear direction.
Figure 4A:
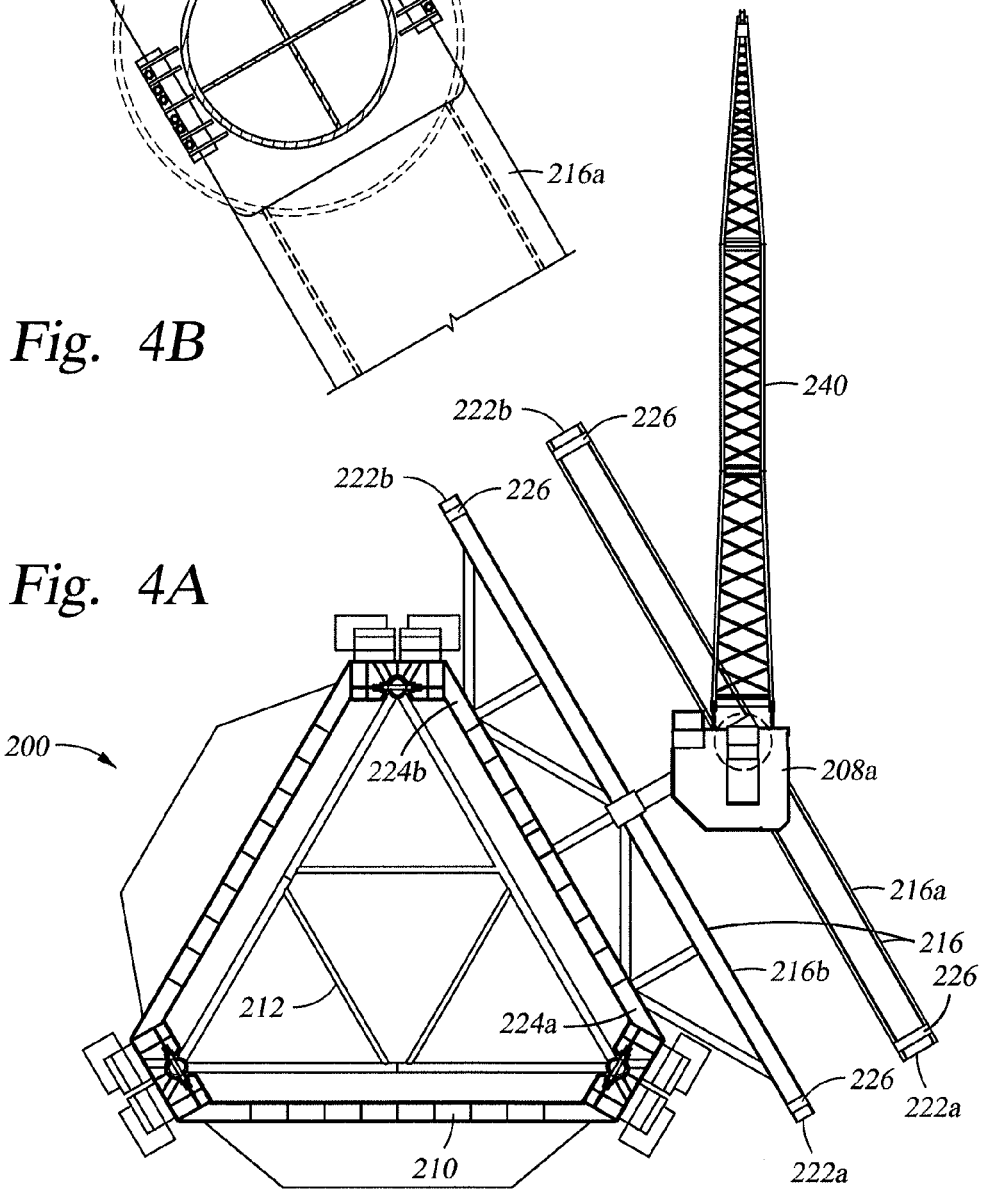

FIGS. 3A, 3B, 4A, and 4B illustrate details of a portion of a jackup rig 200 having a guide-track mounted movable pedestal crane 208*a*. The guide-track 216 may be mounted on a jacking frame 210 connected to the jackup rig 200. As illustrated in FIGS. 3A and 3B, the guide-track 216 may be formed as an arc having a first end of the guide-track 222*a* connected to a first end of a stern jacking frame 224*a* of the jackup rig 200 and a second end of the guide-track 222*b* connected to a second end of the stern jacking frame 224*b* of the jackup rig 200, and having the arced guide-track 216 spaced outwardly of the perimeter of the stern jacking frame 210*a* of the jackup rig 200. As illustrated in FIGS. 4A and 4B, the guide-track 216 alternatively includes linear track members to direct a movable pedestal crane 208*a* coupled thereto linearly along the jackup rig deck platform 206. The guide-track 216 has a first end 222*a* of the guide-track 216 connected to a first end 224*a* of a stern jacking frame 210 of the jackup rig 200 and a second end 222*b* of the guide-track 216 connected to a second end 224*b* of the stern jacking frame 210 of the jackup rig 200, and the linear guide-tracks 216 extend generally parallel to a side of the jacking frame 210 of the jackup rig 200. It is contemplated that the movable pedestal crane 208*a* may be connected to any guide-track 216 which is connected to any jacking frame 210 or other structural member which is secured to the jackup rig 200.

The guide-track 216 provides a fixed path to guide the movable pedestal crane 208*a* from a first location 220*a* to a second location 220*b* along the guide-track 216. The guide-track 216 may be, but is not limited to, a box girder, a tubular girder, a cellular girder, a tubular track, an I-beam track, or any other track type device which may guide a body from a first location to a second location. The guide-track 216 may further have a stopping device 226, such as a bumper, located at the first end 222*a* of the guide-track 216 and the second end 222*b* of the guide-track 216 to prevent the movable pedestal crane 208 from leaving the guide-track 216.

Each movable pedestal crane 208*a*, 208*b* may be moved along the guide-track 216 via a motor (not shown) in operative communication with a gearbox, a drive assembly, and an interface for mechanically maneuvering the movable pedestal crane 208*a*, 208*b* between a first location 220*a* and a second location 220*b* of the jackup rig 200 along the guide-track 216 in order to facilitate servicing of the entire jackup rig deck platform 206 and the adjacent waters. The movable pedestal crane 208*a*, 208*b* may be connected to a chain mechanism (not shown) running under the guide-track 216, wherein the chain mechanism is in operative communication with the motor and the gearbox. A chain may be fastened in a loop, which is wound around a gear at a first end of the guide-track 216 and a second loop at the second end of the guide-track 216. A gear located at one end of the guide-track 216 may be turned by a motor. The gear may turn the chain loop so that it continually moves along the guide-track 216. The movable pedestal crane 208*a*, 208*b* may grip onto the chain with several hinged hooks which allow the movable pedestal crane 208*a*, 208*b* to move between locations when the chain in moved via the motor and gearbox. However, it is to be understood that other actuators may be used to facilitate movement of each movable pedestal crane 208*a*, 208*b* along the guide track 216. For example, it is contemplated that a hydraulic actuator may be utilized to facilitate movement of each movable pedestal crane 208*a*, 208*b*.

FIG. 5 illustrates a side view of the guide-track 216 mounted movable pedestal crane 208*a* on a mobile jackup rig 200. As shown, the crane 208*c* is mounted on a pedestal 208*d* in a vertical orientation. To connect the movable pedestal crane 208*a* to the jacking frame 210 the movable pedestal crane 208*a* may have an upper crane column support beam 502. The upper crane column support beam 502 may be connected via an upper roller assembly 504 to the upper guide-track 216*b* configured as a box girder 506. The upper roller assembly 504 may be contained within the arcuate upper box girder 506. The upper box girder 506 may be supported by a support truss 508 operatively connected to a jacking frame 210 of the jackup rig 200. The movable pedestal crane 208*a* may further be connected via a lower crane roller assembly 510 to the lower guide-track 216*a* likewise configured as a box girder 512. The lower box girder 512 is connected to the jackup rig deck platform 206.

The upper crane column support beam 502 connects the movable pedestal crane 208*a* and the upper guide-track 216*b*. The upper crane column support beam 502 facilitates guiding, or steering, the movable pedestal crane 208*a* along the upper guide-track 216*b* while actuating the movable pedestal crane 208*a* along the guide-track 216. Once the movable pedestal crane 208*a* is located in a desired position, the upper crane column support beam 502 may be fixed relative to the upper guide-track 216*b* to facilitate support and/or distribution of the weight of the movable pedestal crane 208*a*. The upper crane column support beam 502 may provide, or act as, a counterforce 558, a counterweight, or a support column to the force 556 of the movable pedestal crane 208*a* and its load (not shown), a side load, and/or an overturning moment 550 of the movable pedestal crane 208*a*, by providing a counter moment 560 to the moment 550 of the movable pedestal crane 208*a* and the pedestal crane load (not shown) as lifted by the crane hooks 242, while stationary or while in operation. The moment is equivalent to force multiplied by distance. As illustrated in FIG. 5, the moment 550 is equivalent to the force 552 of the movable pedestal crane 208*a* and the pedestal crane load (not shown) as lifted by the crane hooks 242 multiplied by a horizontal distance 554 located between the pedestal 208*d* and the pedestal crane load (not shown) as lifted by the crane hooks 242. Because the upper crane column support beam 502 and/or the pedestal 208*d* reduces the counterweight mass required during operation, the weight of the movable pedestal crane 208*a* is reduced, and maintenance associated with the counterweight is eliminated. The pedestal portion 208*d* of the movable pedestal crane 208*a* may be configured to fully support the moment 550 of the movable pedestal crane 208*a* and its load (not shown), thus eliminating the need for a counterweight. The lower guide-track 216*a* may support the weight of the movable pedestal crane 208*a* and its load while in a stationary position and/or while in operation. The lower guide-track 216*a* may also provide the function of guiding, or steering, the movable pedestal crane 208*a* along the lower guide-track 216*a*.

The movable pedestal crane 208*a*, having an upper crane column support beam 502, is connected via an upper gear assembly to the upper box girder 506. In the embodiment, the upper gear assembly is contained within the upper box girder 506. The upper box girder 506 is supported by a support truss 508 operatively connected to a jacking frame 210 of the jackup rig 200. The movable pedestal crane 208*a* is further connected via a lower crane gear assembly to the lower box girder 512, wherein the lower box girder 512 is connected to the jackup rig deck platform 206.

Program logic may be used to operatively connect multiple movable pedestal cranes 208*a*, 208*b* located on the same jackup rig 200 in order to create a flow of operations with interface protocols such that the multiple pedestal cranes, their respective booms and/or loads, or other movable pedestal crane parts do not collide with one another while moving along the respective guide-track 216. A first movable pedestal crane 208*a* and a second movable pedestal crane 208*b* may be operatively connected in a master-slave arrangement such that the first movable pedestal crane 208*a* takes priority over the entire operating range of the first movable pedestal crane 208*a* as well as over the second movable pedestal crane 208*b*. The first movable pedestal crane 208*a* may occupy a first area of the jackup rig deck platform 206. A second movable pedestal crane 208*b* may attempt to move along the second guide-track 216 and enter the first area of the first movable pedestal crane 208*a*. When the boom 240 of the second movable pedestal crane 208*b* enters the first area of the first movable pedestal crane 208*a*, the program logic may recognize that the first movable pedestal crane 208*a* is operating in and occupying the first area and thus prevent the second movable pedestal crane 208*b* from entering the first area by immediately stopping the second movable pedestal crane 208*b* and preventing further movement of the second movable pedestal crane 208*b* in the direction of the first area of the first movable pedestal crane 208*a*, thus preventing the second movable pedestal crane 208*b*, its boom 240 and/or load, or other respective parts from colliding with the first movable pedestal crane 208*a*, its boom 240 and/or load, or other respective parts.

Figure 6A:
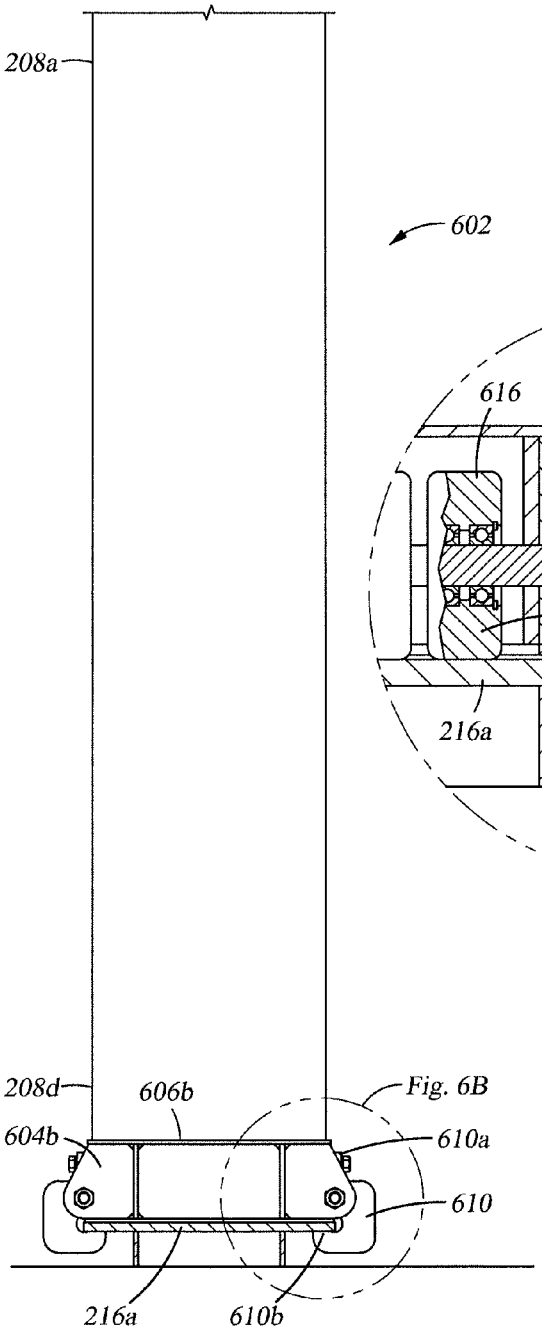
FIGS. 6A and 6B illustrate a side view of an embodiment of a guide-track mounted movable pedestal crane.
Figure 6B:
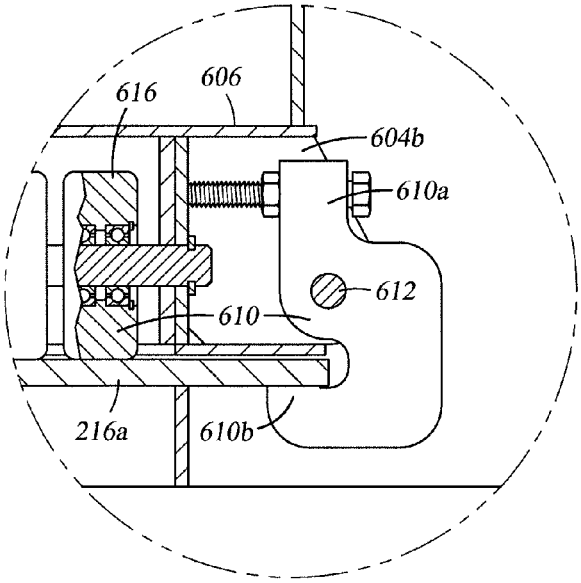
Figure 7B:
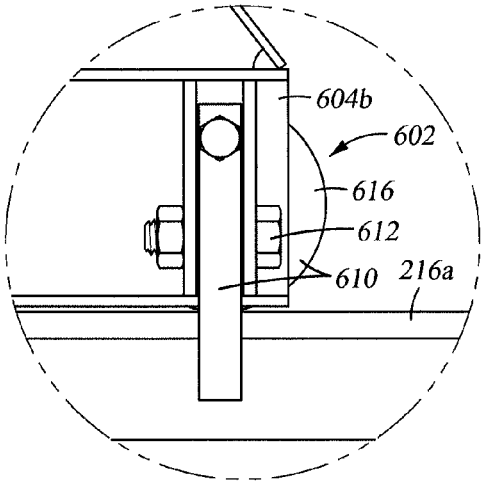
FIGS. 7A and 7B illustrate a side view of an embodiment of a guide-track mounted movable pedestal crane.
Figure 7A:
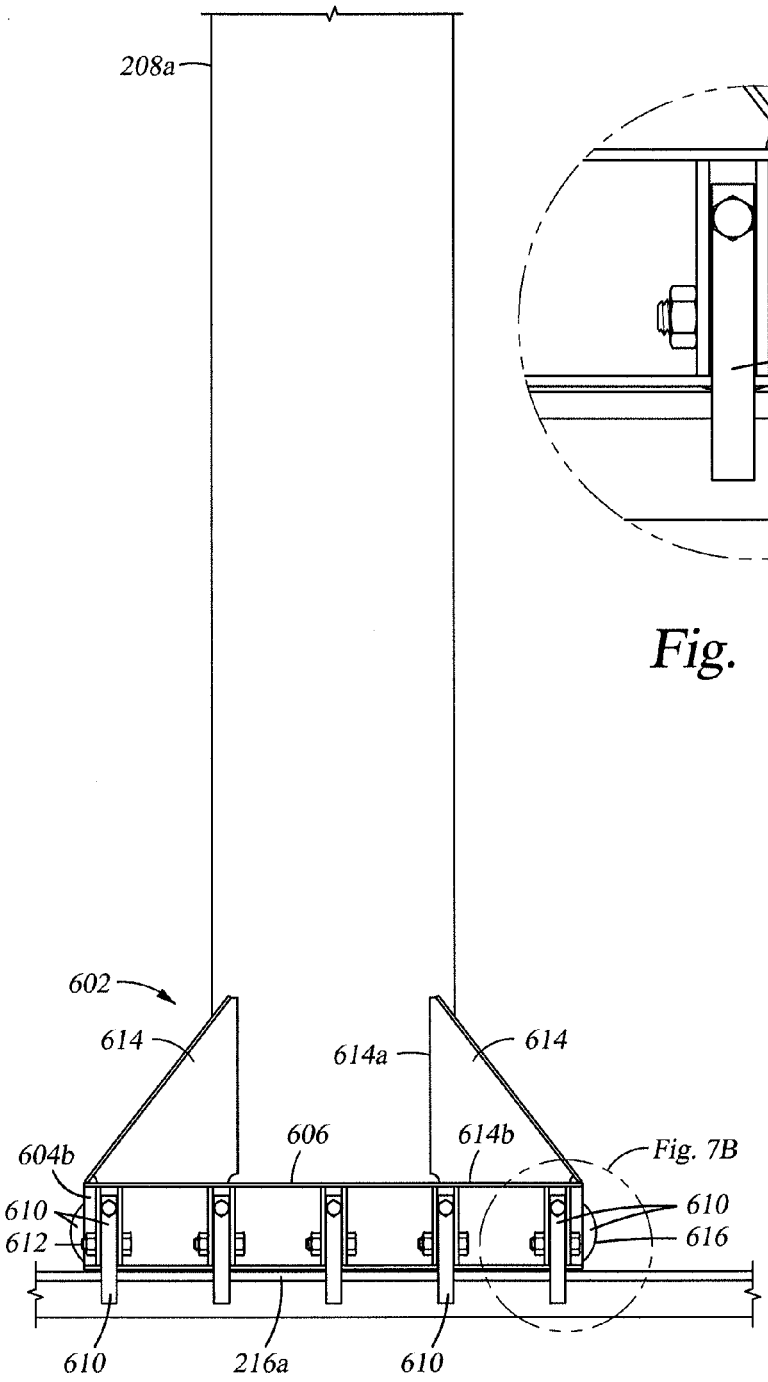
Figure 8:
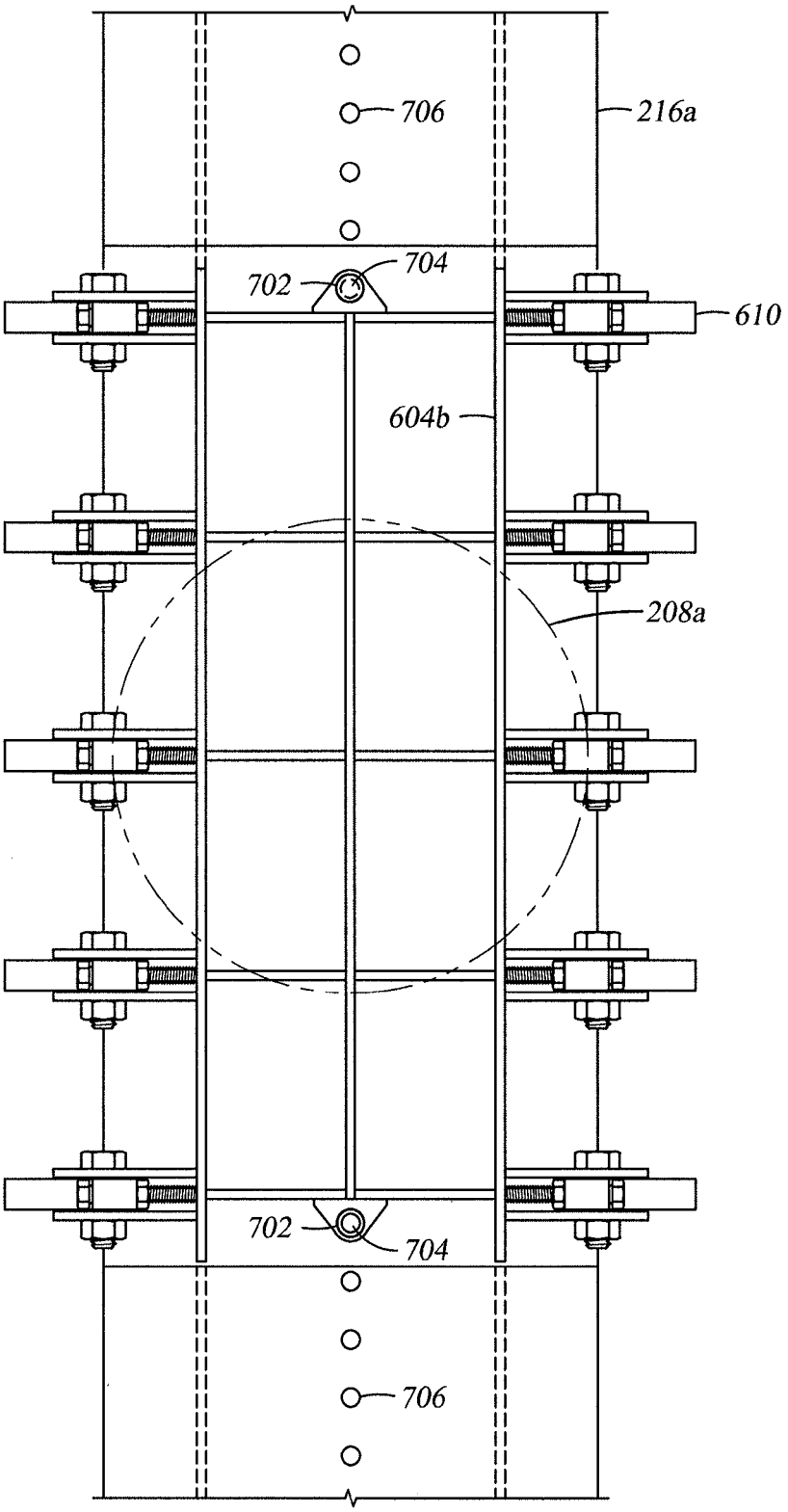
FIG. 8 illustrates a top view of an embodiment of a guide-track mounted movable pedestal crane.

FIGS. 6A, 6B, 7A, and 7B illustrate the connection of the movable pedestal crane 208*a* to the guide-tracks 216 via a hook and roller assembly and rail connection system 602. In the illustrated embodiment, the connection of the base of the movable pedestal crane 208*a* to the guide-track 216*a*, and an end of the upper crane column support beam 502 to guide-track 216*b* are of the same construct. Thus, only the connection of the base of the movable pedestal crane 208*a* to the guide-track 216*a* is described. Although, the first base plate 604*a* may have the same construct as the second base plate (not shown), it is contemplated that the first and second base plates may be sized differently depending on the requirements of the jackup rig 200. Here, the same construct of the second base plate applies to the first base plate 604*a*, and the same construct of the bottom base 606*b* of the movable pedestal crane 208*a* applies to the bottom base (not shown) of the upper crane column support beam 502. A second base plate 604*b* is connected to a bottom base 606*b* of the movable pedestal crane 208*a* and located between the movable pedestal crane 208*a* and the lower guide-track 216*a*. A first base plate 604*a* may be connected to a bottom base 606*a* of the upper crane column support beam 502 and located between the upper crane column support beam 502 and the upper guide-track 216*b*. The second and first base plates 604*b*, 604*a* can be configured as a skid plate, a skidding mechanism, a hydraulic skidding mechanism, and/or an electric skidding mechanism for skidding from a first location 608*a* to a second location 608*b*. The second base plate 604*b* is located at or on the end of the pedestal 208*d* of the movable pedestal crane 208*a*. The first base plate is located at or on the end of the upper crane column support beam 502. The second base plate 604*b* and first base plate may have a length extending beyond the diameter of the pedestal 208*d* of the movable pedestal crane 208*a*, as shown in FIG. 8, in order to prevent a toppling moment of the movable pedestal crane 208*a*. A plurality of hook and roller assemblies 610—a hooked shaped mechanism with a first end 610*a* and a second end 610*b*, having a roller 616 connected to the hooked shaped mechanism—may be connected to a first side and a second side of the second base plate 604*b* and the first base plate 604*a*, the first side of the base plate being opposite the second side of the base plate, by a connection rod 612. The connection rod 612 may secure a first end of the hook and roller assemblies 610 to the base plate 604 and allow the hook and roller assemblies 610 to individually articulate and pivot in a hinge-like manner about the longitudinal axis of the connection rod 612, as an articulating joint. When the hook and roller assemblies 610 are oriented in a downward position such that a second end 610*b* of the hook and roller assemblies 610 are located at least below the connection rod 612, the hook and roller assemblies 610 may form a connection to a guide-track 216 thus securing the movable pedestal crane 208*a* to the guide-track 216 and allowing the hook and roller assemblies 610 to ride on the guide-track 216. The guide-track 216 may be a box girder with extending flanges at the top of and bottom of the box girder, where the top is opposite the bottom, on a first side and a second side, the first side being opposite the second side; an I-beam; a beam with a flange; and/or a beam of any shape. The hook and roller assemblies 610 may be formed in a complimentary shape of the guide-track 216 such that a reciprocal, or coupled, connection may be had between the hook and roller assemblies' shape and the guide-track rail shape, as illustrated in FIGS. 6A and 6B. The hook and roller assemblies 610 may extend the length of the base plate 604, and the base plate 604 may be extended to a length greater than a diameter of the base of the upper crane column support beam 502 or the diameter of the base of the movable pedestal crane 208*a*, respectively, in order to provide support and weight distribution for the movable pedestal crane 208*a*, as shown in FIG. 7A. Separate individual hook and roller assemblies 610 placed along the first side and the second side of both the first base plate 604*a* and the second base 604*b* plate may allow the first base plate 604*a*, the second base plate 604*b*, the upper crane column support beam 502, and movable pedestal crane 208*a* to articulate about curves in the guide-track 216, the hook and roller assemblies 610 being permitted to rotate and pivot about the longitudinal axis of the connection rod 612, as an articulating joint, as the base plate 604*a*, 604*b* is moved from a first location 608*a* to a second location 608*b* along the guide-track 216. The use of separate and individual hook and roller assemblies 610 allows each to provide an independent suspension point for the upper crane column support beam 502 on the first base plate 604*a* and the movable pedestal crane 208*a* on the second base plate 604*b*. An individual bolt may also be used to connect each individual hook and roller assembly 610 to the base plate 604*a*, 604*b* thus creating the same effects as the connection rod 612.

The hook and roller assemblies 610 may further be tightened via the connection rod 612 and/or the individual bolts used to connect the base plates 604*a*, 604*b* to the guide-track 216 when the movable pedestal crane 208*a*, 208*b* is in operation in order to secure the movable pedestal crane 208*a*, 208*b* to the guide-track 216. Securing the movable pedestal crane 208*a*, 208*b* to the guide-track 216 may prevent further movement of the movable pedestal crane 208*a*, 208*b* along the guide-track 216. The hook and roller assemblies 610 may be loosened when the movable pedestal crane 208*a*, 208*b* requires movement along the guide-track 216.

FIGS. 7A and 7B illustrate a side view of the movable pedestal crane 208*a* of FIGS. 6A and 6B connected to the guide-track 216 via the hook and roller assembly and rail connection system 602. As illustrated in FIGS. 7A and 7B, a base plate 604*b* is connected to the bottom base 606 of the movable pedestal crane 208*a*. A base plate 604*a* may also be connected to the base 606 of the upper crane column support beam 502. The connection between the base plate 604*b* and the movable pedestal crane 208*a* may have support gussets 614 for reinforcement as well as to provide stability for the connection between the movable pedestal crane 208*a* and base plate 604*b*. A first side 614*a* of each gusset 614 may be connected via a bolting or other securing mechanism to the movable pedestal crane 208*a*. A second side 614*b* of the gusset 614 may be connected via a bolting or other securing mechanism to the base plate 604*b*. Five hook and roller assemblies 610 are shown on the first side of the base plate 604, and five hook and roller assemblies 610 may be used on the second, opposite, side of the base plate 604 to connect the base plate 604*a* of the upper crane column support beam 502 with the upper guide-track 216*b* and the base plate 604*b* of the movable pedestal crane 208*a* with the lower guide-track 216*a*. It should be noted, however, that any number of hook and roller assemblies 610 may be used to connect the base plate 604*a* of the upper crane column support beam 502 to the upper guide-track 216*b* and the base plate 604*b* of the movable pedestal crane 208*a* to the lower guide-track 216*a*.

A movable pedestal crane 208*a*, 208*b* for use on a jackup rig 200 is either, at times, in operation or at rest. When the movable pedestal crane 208*a*, 208*b* is not in operation the boom 240 of the movable pedestal crane 208*a*, 208*b* may be stored in a boom rest in order to ensure the boom 240 is secured and not subject to activity from winds, waves, extreme weather conditions, and/or other equipment. The boom rest supports the weight of the boom 240 and stows the boom 240 by securing the boom 240 on or within the boom rest when the movable pedestal crane 208*a*, 208*b* is not in use. The boom rest is designed to withstand the combination of motions and environmental forces resulting from the most extreme design conditions for the jackup rig 200. As the movable pedestal crane 208*a*, 208*b* is moveable along the guide-track 216, the boom rest for resting, supporting, and stowing the pedestal crane boom 240 may also be moveable about the jackup rig 200, thus creating the ability to further free up needed jackup rig deck platform 206 space. To illustrate, if jackup rig deck platform 206 space is needed on the port side of the jackup rig 200, the port movable pedestal crane 208*b* may be moved along the guide-track 216 such that the movable pedestal crane 208*b* may be facing the starboard side of the jackup rig 200. As such, the boom rest for the port movable pedestal crane 208*b* may be moved from the port side of the jackup rig 200 to the starboard side of the jackup rig 200 thus freeing up additional space on the port side of the jackup rig 200. The present design allows for multiple options for resting the movable pedestal crane 208*a*, 208*b* and its boom 240 when the movable pedestal crane 208*a*, 208*b* is not in operation.

FIG. 8 illustrates a securing mechanism of the movable pedestal crane 208*a* for securing the movable pedestal crane 208*a* to the jackup rig 200 or structural members of the jackup rig. Upon securing the movable pedestal crane 208*a* to the jackup rig 200 or structural members of the jackup rig, the load of the movable pedestal crane 208*a* may be transferred to the jackup rig 200, jackup rig deck platform 206, or structural members of the jackup rig. As illustrated, in this embodiment the guide-track 216*a* is in a generally straight line path as shown in FIG. 4A, and base plate 604 is generally rectangular. The base plate 604 is connected to a base 606 of the movable pedestal crane 208*a* and located between the movable pedestal crane 208*a* and the lower guide-track 216*a*. Upon the movable pedestal crane 208*a* reaching a desired work location along the guide-track 216 the movable pedestal crane 208*a* may be secured to or with the jackup rig 200, the jackup rig deck platform 206, the guide-track 216, and/or the jacking frame 210 in order to prevent the movable pedestal crane 208*a* from further movement. The movable pedestal crane 208*a* may be secured after movement along the guide-track 216 and during operation. The movable pedestal crane 208*a* may further be secured during non-operation of the movable pedestal crane 208*a*, during inclement weather, and/or during jackup rig 200 movement and positioning. The movable pedestal crane 208*a* may be secured to the guide-track 216, the jackup rig 200, the jackup rig deck platform 206, and/or a jacking frame 210 by a pin mechanism 702, a locking mechanism, a nut and bolt assembly, a fastener, and/or any other device for securing a first member to a second member. The movable pedestal crane 208*a* may be secured to the guide track 216, the jackup rig 200, the jackup rig deck platform 206, and/or the jacking frame 210 at more than one location. At least one first hole 704 may extend through a base plate 604 connected to the movable pedestal crane 208*a*. At least one second hole 706 may extend through the guide-track 216, the jackup rig 200, the jackup rig deck platform 206, and/or the jacking frame 210, such that when the at least one first hole 704 and the at least one second hole 706 are aligned a pin 702 may be inserted and secured through the aligned first hole 704 and the aligned second hole 706. The inserted and secured pin 702 may prevent the movable pedestal crane 208*a* from further movement. Multiple holes may extend throughout the length of the guide-track 216, the jackup rig 200, the jackup rig deck platform 206, and/or the jacking frame 210 such that the movable pedestal crane 208*a* may be secured to the guide-track 216, the jackup rig 200, the jackup rig deck platform 206, and/or the jacking frame 210 at any location along the guide-track 216, the jackup rig 200, the jackup rig deck platform 206, and/or the jacking frame 210. Additionally, multiple holes may extend through multiple locations on the guide track 216 such that other connections between the guide-track 216, the jackup rig 200, the jackup rig deck platform 206, and/or the jacking frame 210 and the base plate 604 of the movable pedestal crane 208*a* may be made. The movable pedestal crane 208*a* may be secured to the jackup rig 200 on the jackup rig deck platform 206, the jacking frame 210, and/or at a box beam located on the jackup rig 200. Additionally, the movable pedestal crane 208*a* may be secured to the jackup rig 200, the guide-track 216, and/or the jacking frame 210 via a bolting system wherein a bolt is inserted through the at least one first hole 704 extending through the base plate 604 connected to the movable pedestal crane 208*a* and the at least one second hole 706 extending through the guide-track 216, the jackup rig 200, and/or the jacking frame 210. After insertion of the bolt through the hole, the bolt may be secured with a nut attaching to the threads of the bolt.

Benefits of the present disclosure include a reduction in costs and expenses of oil rigs and platforms. Costs and expenses are reduced through an overall weight reduction of rigs and an increase in the amount of usable space on rigs. A lower equipment weight and an increase in usable space result not only in lower costs and expenses but also allow for more personnel and/or equipment, including test or experimental equipment. The ability to increase deck space and reduce weight has significant advantages for jackup rigs specifically. Reductions in equipment result in an increase of overall deck space and a reduction in weight of the jackup rig, thus resulting in a jackup rig comprising more usable space for more personnel, larger work areas, test equipment, other projects, etc.

While the foregoing is directed to embodiments of the present disclosure, other and further embodiments of the disclosure may be devised without departing from the basic scope thereof, and the scope thereof is determined by the claims that follow.

What is claimed is:

1. A mobile jackup rig comprising:

a jackup rig deck platform having a first side, a second side, and a third side;

a first two-rail system and a second two-rail system, wherein the first two-rail system and the second two-rail system each comprise a first guide-track rail and a second guide-track rail; and a first crane capable of connecting with the first two-rail system and a second crane capable of connecting with the second two-rail system, the first two-rail system being positioned on the jackup rig deck platform to enable the first crane to service only the first and second sides of the jackup rig deck platform, the second two-rail system being positioned on the jackup rig deck platform to enable the second crane to service only the second and third sides of the jackup rig deck platform.

2. The mobile jackup rig of claim 1, wherein the crane is a pedestal crane.

3. The mobile jackup rig of claim 1, wherein each of the first guide-track rails and the second guide-track rails are formed in an arc extending from a first location to a second location.

4. The mobile jackup rig of claim 1, wherein each of the first guide-track rails and the second guide-track rails are formed in a line extending from a first location to a second location.

5. The mobile jackup rig of claim 1, wherein the first and second two-rail systems are connected with a jacking frame of the mobile jackup rig.

6. The mobile jackup rig of claim 1, wherein the first guide-track rails are positioned below the second guide-track rails.

7. The mobile jackup rig of claim 1, wherein the first guide-track rail of the first two-rail system supports the weight of the first crane and the second guide-track rail of the first two-rail system supports a moment induced by the first crane and guides the first crane.

8. The mobile jackup rig of claim 1, further comprising a hook and roller assembly and rail connection system for connecting the first crane to the first two-rail system, the hook and roller assembly and rail connection system comprising:

a base plate;

at least one hook-shaped mechanism, wherein the hook-shaped mechanism comprises a rolling mechanism and is configured to couple with the first guide-track rail and the second guide-track of the first two-rail system; and a connection rod for securing the at least one hook-shaped mechanism to the base plate and allowing the hook-shaped mechanism to rotate about a longitudinal axis of the connection rod.

9. The hook and roller assembly and rail connection system of claim 8, wherein the base plate has a length greater than a diameter of a base of the first crane.

10. The mobile jackup rig of claim 1, further comprising a lower box girder and an upper box girder, wherein the first crane is connected to the lower box girder with a first roller assembly and connected to the upper box girder with a second roller assembly, wherein the first roller assembly and the second roller assembly allow for longitudinal movement of the first crane along the first guide-track rail from a first position to a second position.

11. The mobile jackup rig of claim 1, further comprising:

a gearbox for mechanically moving the first crane along the first guide-track rail system;

a motor;

a drive assembly; and an interface in operable communication with the motor and the drive assembly.

12. The mobile jackup rig of claim 1, wherein a first end of the first two-rail system is proximate the first side of the jackup rig deck platform and a second end of the first two-rail system is proximate the second side of the jackup rig deck platform, and wherein a first end of the second two-rail system is proximate the first side of the jackup rig deck platform and a second end of the second two-rail system is proximate the third side of the jackup rig deck platform.

13. A mobile jackup rig comprising:

a platform;

at least one pedestal crane; and at least one curved guide-track rail system including a first guide-track rail and a second guide-track rail, wherein the at least one pedestal crane is capable of connecting with the at least one curved guide-track rail system, wherein the first guide-track rail is secured to the platform and the second guide-track rail is vertically spaced from the platform.

14. The mobile jackup rig of claim 13, wherein the at least one pedestal crane includes a first pedestal crane and a second pedestal crane, and the at least one curved guide-track system includes a first curved guide-track rail system and a second curved guide-track rail system, wherein the first pedestal crane is capable of connecting with the first curved guide-track rail system and the second pedestal crane is capable of connecting with the second curved guide-track rail system.

15. The mobile jackup rig of claim 13, wherein the curved guide-track rail system is connected with a jacking frame of the mobile jackup rig.

16. The mobile jackup rig of claim 13, wherein the first guide-track rail supports the weight of the pedestal crane, and the second guide-track rail supports a moment induced by the pedestal crane and guides the pedestal crane.

17. The mobile jackup rig of claim 13, further comprising a hook and roller assembly and rail connection system for connecting the pedestal crane to the curved guide-track rail system, the hook and roller assembly and rail connection system comprising:

a base plate;

at least one hook-shaped mechanism, wherein the hook-shaped mechanism comprises a rolling mechanism and is configured to couple with the curved guide-track rail system; and a connection rod for securing the at least one hook-shaped mechanism to the base plate and allowing the hook-shaped mechanism to rotate about a longitudinal axis of the connection rod.

18. The hook and roller assembly and rail connection system of claim 17, wherein the base plate has a length greater than a diameter of the base of the pedestal crane.

19. The mobile jackup rig of claim 13, further comprising a lower box girder and an upper box girder, wherein the pedestal crane is connected to the lower box girder with a first roller assembly and connected to the upper box girder with a second roller assembly, wherein the first roller assembly and the second roller assembly allow for longitudinal movement of the pedestal crane along the guide-track rail from a first position to a second position.

20. A mobile jackup rig comprising:

a platform;

at least one crane; and at least one two-rail system comprising a first guide-track rail and a second guide-track rail, the first guide-track rail being secured to the platform and the second guide-track rail being vertically spaced from the platform, the at least one crane connecting with the two-rail system in a manner such that the first guide-track rail supports the weight of the crane and the second guide-track rail counteracts a moment induced by the crane.

* * * * *